US007616920B2

(12) United States Patent
Matsumoto et al.

(10) Patent No.: US 7,616,920 B2
(45) Date of Patent: Nov. 10, 2009

(54) IMAGE HEATING APPARATUS WITH ENDLESS BELT POSITIONING DEVICE

(75) Inventors: Hiroshi Matsumoto, Toride (JP); Naohisa Nagata, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 276 days.

(21) Appl. No.: 11/244,278

(22) Filed: Oct. 6, 2005

(65) Prior Publication Data

US 2006/0083562 A1 Apr. 20, 2006

(30) Foreign Application Priority Data

Oct. 19, 2004 (JP) ..... 2004-304218
Aug. 9, 2005 (JP) ..... 2005-230806

(51) Int. Cl.
*G03G 15/20* (2006.01)

(52) U.S. Cl. ..... 399/329; 399/68

(58) Field of Classification Search ..... 399/68, 399/122, 307, 329
See application file for complete search history.

(56) References Cited

U.S. PATENT DOCUMENTS 5,305,066 A * 4/1994 Koh et al.
5,666,624 A * 9/1997 Kanesawa et al. ..... 399/329
6,457,709 B1 * 10/2002 Madsen et al.

FOREIGN PATENT DOCUMENTS

| | | | |
|---|---|---|---|
| JP | 04181276 A | * | 6/1992 |
| JP | 5-27622 | | 2/1993 |
| JP | 11-194647 | | 7/1999 |

OTHER PUBLICATIONS

Machine translation of Ueki, JP Pub. 11-194647, submitted previously on an IDS.*

* cited by examiner

*Primary Examiner*—David M Gray
*Assistant Examiner*—Laura K Roth
(74) *Attorney, Agent, or Firm*—Fitzpatrick, Cella, Harper & Scinto

(57) ABSTRACT

In an endless belt type image heating apparatus, in accordance with an endless belt contact state, an endless belt rotational speed, and a kind of a recording material, the steering displacement of an endless belt deviation control is determined, and excess the endless belt deviation is prevented by complimenting the control factoring a deviation tendency.

3 Claims, 9 Drawing Sheets

IMAGE HEATING APPARATUS WITH ENDLESS BELT POSITIONING DEVICE

BACKGROUND OF THE INVENTION

1. Field of the Invention

The present invention relates to an image heating apparatus for heating images on a recording material used in an image-forming apparatus employing an electrophotographic system or an electrostatic recording system. The image heating apparatus may include a fixing device for fixing unfixed images on a recording material and a gloss increaser for increasing the gloss of images by heating the images fixed on the recording material.

2. Description of the Related Art

So-called belt fixing devices using a fixing roller and a pressure belt have been devised (Japanese Patent Laid-Open No. 11-194647 and Japanese Patent Laid-Open No. 5-27622, for example).

Specifically, in the belt fixing device, a recording material carrying unfixed toner images thereon is introduced into a fixing nip between the fixing roller and the pressure belt so as to fix the toner images on the recording material with heat and pressure while the recording material being pinched and conveyed.

In such a belt fixing device, the width of the fixing nip (the length of the fixing nip in the conveying direction of the recording material) can be increased in comparison with that of a conventional roller fixing device using a fixing roller and a pressure roller.

Since the width of the fixing nip of such a belt fixing device can be increased without increasing the diameter of the fixing roller, the thermal capacity can be reduced, enabling the warming-up period to be decreased.

For at least this reason, the application of the belt fixing device to a color image-forming apparatus is particularly advantageous in view of the melting and color mixing of the multi-color toner images formed on the recording material.

In the belt fixing device, the belt shows a tendency to deviate in its width-wise direction (direction perpendicular to the belt rotational direction), so that the belt deviation must be restricted.

In the conventional belt fixing devices mentioned above, a system in that the belt is swung in the width-wise direction by displacing a belt stretching roller has been proposed. According to this system, the belt can be prevented from being buckled and damaged as a result of contacting another member at its end.

However, in the above system, the control cannot respond to the deviation of the belt between when it abuts the fixing roller and when it is separated therefrom, so that the belt may fully deviate.

This may be caused by the fact that the load applied to the belt when the belt is separated from the fixing roller is smaller than that when it abuts the fixing roller so that the rocking speed of the belt is increased.

Thus, by the conventional belt rocking system, the belt may fully deviate and be damaged.

SUMMARY OF THE INVENTION

The present invention provides an image heating apparatus capable of appropriately rocking a belt.

In accordance with one aspect of the present invention, an image heating apparatus includes a heating rotary member for heating an image on a recording material, an endless belt to form a heating nip with the heating rotary member; and rocking means for rocking the belt in its width-wise direction, and the rocking means changing rocking conditions in accordance with a load applied to the endless belt.

Further features of the present invention will become apparent from the following description of exemplary embodiments with reference to the attached drawings.

DESCRIPTION OF THE EMBODIMENTS

Embodiments according to the present invention will be described below with reference to the drawings. In addition, various structures of the embodiments which will be described later may be appropriately modified with other known structures within the scope and spirit of the present invention.

(1) Image-Forming Section

Figure 2:
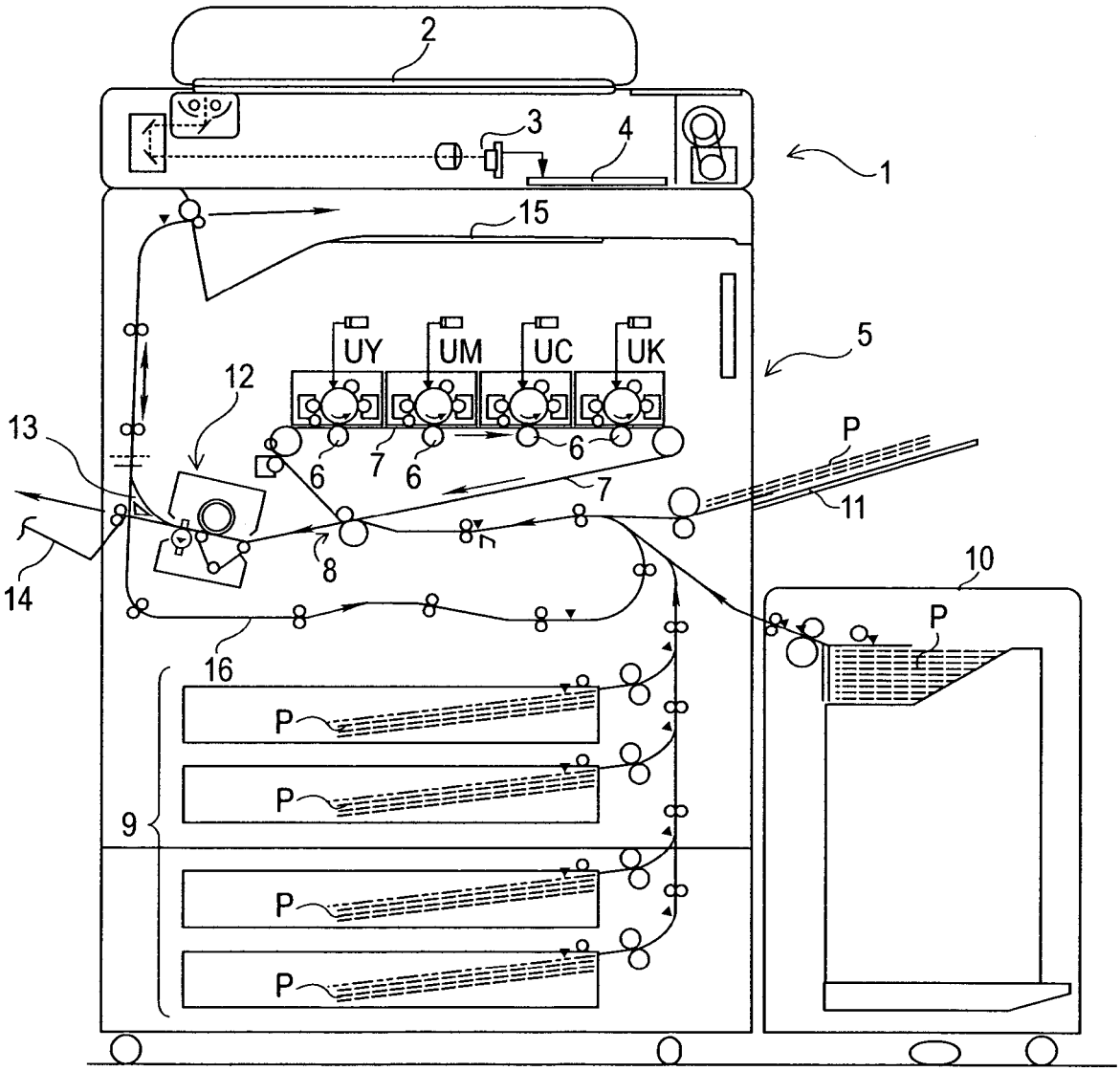
FIG. 2 is a longitudinal sectional view of a schematic structure of an image-forming apparatus according to the embodiment.

FIG. 2 is a longitudinal sectional view of an electrophotographic full-color copying machine as an example of an image-forming apparatus having a belt fixing device mounted thereon. First, an image-forming section will be schematically described.

A digital color image reader 1 photoelectrically reads the images of a color-image document placed on a document glass plate 2 to have a color-separation image signal with a full-color sensor (CCD) 3. The color-separation image signal is fed to a digital color-image printer 5 after being processed in an image processor 4.

In the printer 5, four first to fourth image-forming units UY, UM, UC, and UK are tandemly arranged. The respective image-forming units are a laser-exposure type photoelectric processing mechanism, in which based on the color-separation image signal fed to the printer 5 from the reader 1, the first image-forming unit UY forms yellow toner images on the surface of a photosensitive drum; the second image-forming unit UM forms magenta toner images; the third image-forming unit UC forms cyan toner images; and the fourth image-forming unit UK forms black toner images at a predetermined timing.

The toner images formed on each photosensitive drum of each image-forming unit are sequentially transferred on an intermediate transfer belt 7 in a primary transfer section 6 so as to overlap on the other for forming unfixed full-color toner images on the intermediate transfer belt 7 by melting and combining the four toner images. The combined full-color toner images are sequentially and secondarily transferred onto a recording material P fed from a cassette feed mechanism 9, a deck paper feeder 10, or a manual paper feeder 11 to a secondary transfer section 8 at a predetermined timing.

The recording material P is separated from the intermediate transfer belt 7 and fed to a belt fixing device (fixing unit) 12 so as to be introduced into a fixing nip of the belt fixing device 12 while being pinched and conveyed. In this process, the unfixed full-color toner images are melted and combined with heat and pressure so as to form full-color permanently fixed images on the recording material P. The recording material P discharged from the belt fixing device 12 is switched at a flapper 13 to proceed to a face-up discharge tray 14 or a face-down discharge tray 15.

When a two-sided print mode is selected, the recording material P with a printed first surface is initially fed to a sheet path leading to the face-down discharge tray 15 by the flapper 13; then, it is switched back to a retransfer sheet-path 16, and is again introduced to the secondary transfer section 8 in a turned over state. As a result, the toner images are secondarily transferred onto a second surface of the recording material P. Thereafter, the recording material P, in the same way as in the first surface printing, is introduced into the belt fixing device 12 so that the recording material P with printed both-side surfaces is discharged to the face-up discharge tray 14 or the face-down discharge tray 15.

(2) Belt Fixing Device 12

Figure 1:
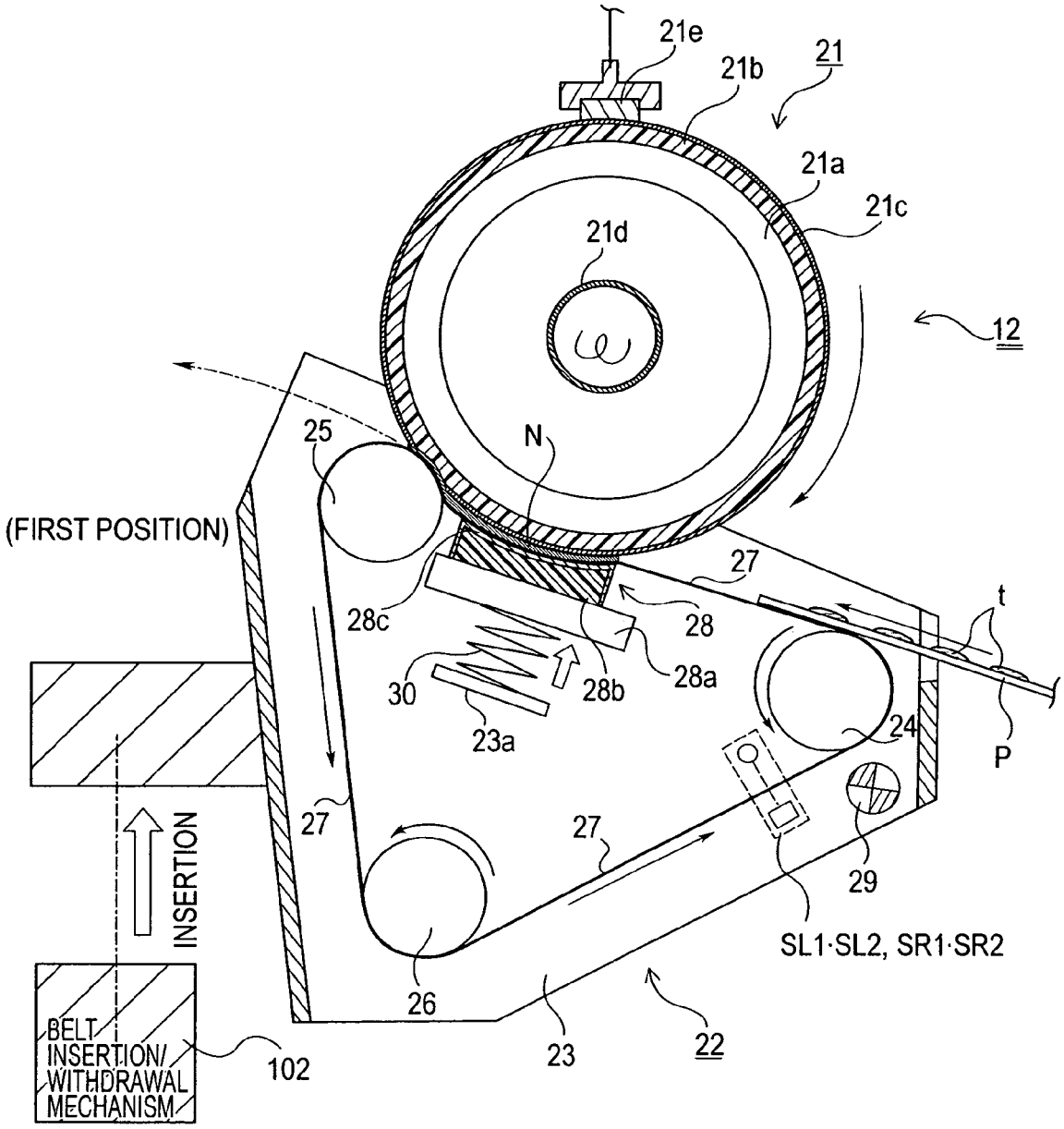
FIG. 1 is a cross-sectional view of a schematic structure of a belt fixing device according to an embodiment (in an inserted state of a pressure belt)

FIG. 1 is a schematic longitudinal sectional view of the belt fixing device 12 which serves as an image heating apparatus.

A fixing roller 21 is a laminated fixing rotary body (heating rotary body) including a hollow core bar 21*a* covered with an elastic layer 21*b*, such as silicon rubber, and a release layer 21*c*, such as a fluororesin, further covering the external surface of the elastic layer 21*b*. Within the fixing roller 21, a heat source 21*d*, such as a halogen lamp, is inserted. The fixing roller 21 is journaled at both the longitudinal ends on bilateral side plates (not shown) of the fixing device with bearing members therebetween. A temperature detecting element 21*e* is arranged in contact with or in proximity to the surface of the fixing roller 21 for detecting the surface temperature of the fixing roller 21. The fixing roller 21 is rotated clockwise in the direction of the arrow at a predetermined speed by a drive mechanism (not shown) including a motor and a gear train.

A belt unit 22 is arranged below the fixing roller 21, and includes a unit frame 23 and first to third guiding rollers 24 to 26 journaled on the bilateral side plates of the unit frame 23 approximately in parallel with the fixing roller 21. An endless pressure belt 27 is stretched around the three rollers 24 to 26. On the internal side of the pressure belt 27, a pressure pad 28 is provided so as to oppose the lower surface of the fixing roller 21 for forming a fixing nip.

In the belt unit 22, the bilateral side plates of the unit frame 23 are pivoted between the bilateral side plates of the fixing device, respectively, and the belt unit 22 is arranged to support the fixing roller 21 rockably (swingably) about its pivot 29 in the vertical direction.

The pressure belt 27 is made of a heat-resistant resin, such as polyimide, so as to form an endless belt.

Among the first to third rollers 24 to 26, the first roller 24 is arranged at a position adjacent to the inlet for the recording material P, and is counterclockwise rotated in the direction of the arrow at a predetermined speed by the drive mechanism. The first roller 24 is referred to below as a belt drive roller.

The second roller 25 is functioning as a recording material separation roller for separating the recording material P from the surface of the fixing roller 21 at the recording material outlet of a fixing nip N by pressing the fixing roller 21 via the pressure belt 27 so as to break into the elastic layer 21*b* of the fixing roller 21. The second roller 25 is referred to below as a separation roller.

The third roller 26 is arranged below and between the belt drive roller 24 and the separation roller 25, and functions as a tension roller for applying a tension to the pressure belt 27. Furthermore, the roller 26 controls the belt deviation in the width direction as is described later, functioning as a steering roller for rocking the belt. The third roller 26 is referred to below as a steering roller.

The pressure pad 28 is a laminated body including a base plate 28*a* laminated with an elastic layer 28*b* and a slippery layer 28*c* (low-friction sheet layer) further laminating the elastic layer 28*b*. The pressure pad 28 is urged into contact with part of the pressure belt 27 between the belt drive roller 24 and the separation roller 25 by a push-up spring 30 provided between the base plate 28*a* and a spring receiving plate 23*a* arranged on the bilateral side plates of the unit frame 23.

A belt insertion/withdrawal mechanism 102 rocks the belt unit 22 about the pivot 29 in the vertical direction so as to switch the pressure belt 27 between placing itself in contact with the fixing roller 21 and placing itself out of contact therewith and serving as touching/separating means.

Figure 4:
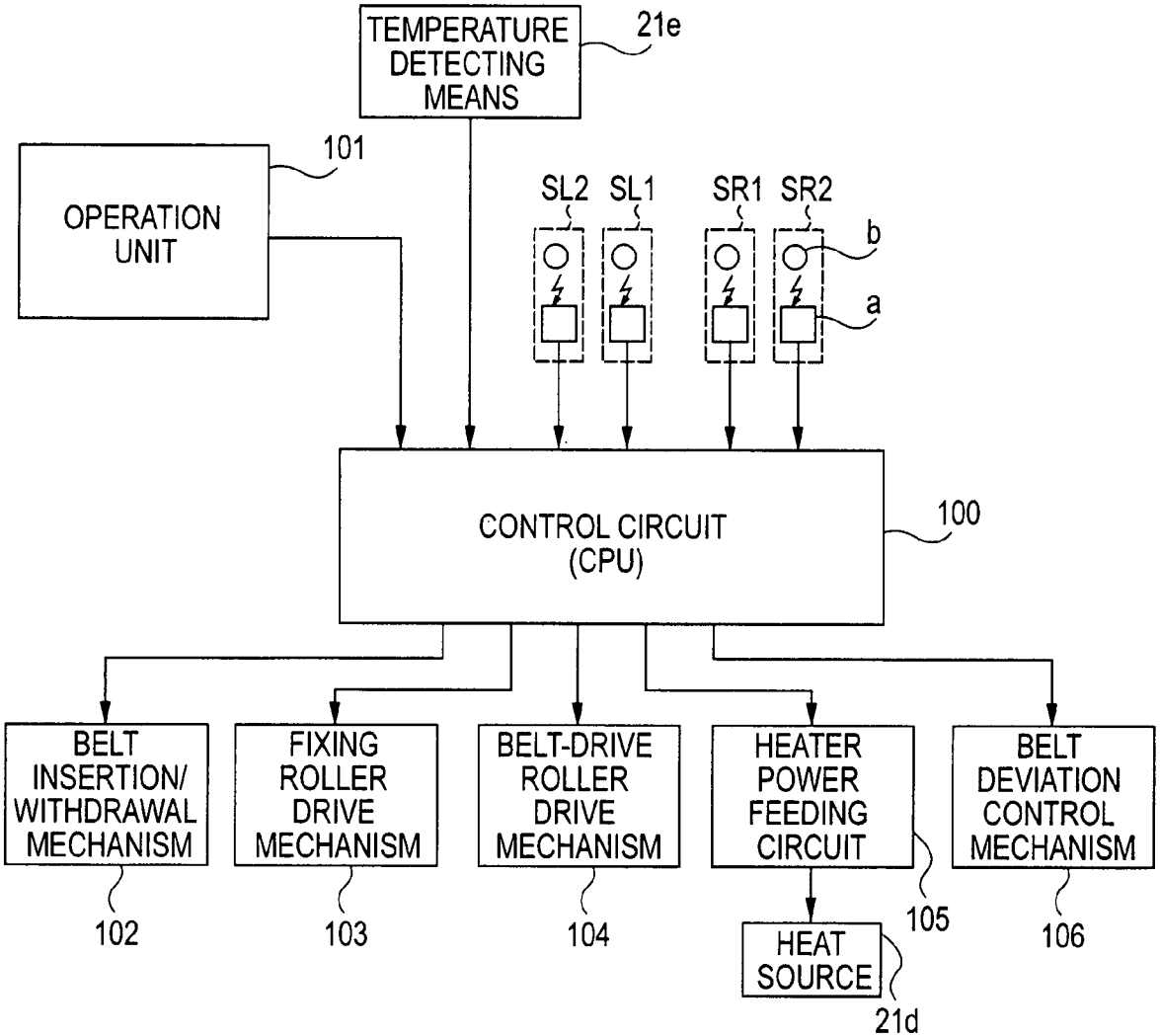
FIG. 4 is a block diagram of a control system.

The belt insertion/withdrawal mechanism 102 is controlled to perform an "insertion operation" and a "withdrawal operation" as follows by a control circuit 100 (FIG. 4).

(Insertion Operation)

As shown in FIG. 1, the belt unit 22 is rotated about the pivot 29 toward the fixing roller 21 so that the pressure belt 27 is pinched between the separation roller 25 and the fixing roller 21 under a predetermined pressure. The position in which the belt abuts the fixing roller in such a manner is referred to as the first position below. As a result, a wide nip N is formed between the fixing roller 21 and the pressure belt 27.

(Withdrawal Operation)

Figure 3:
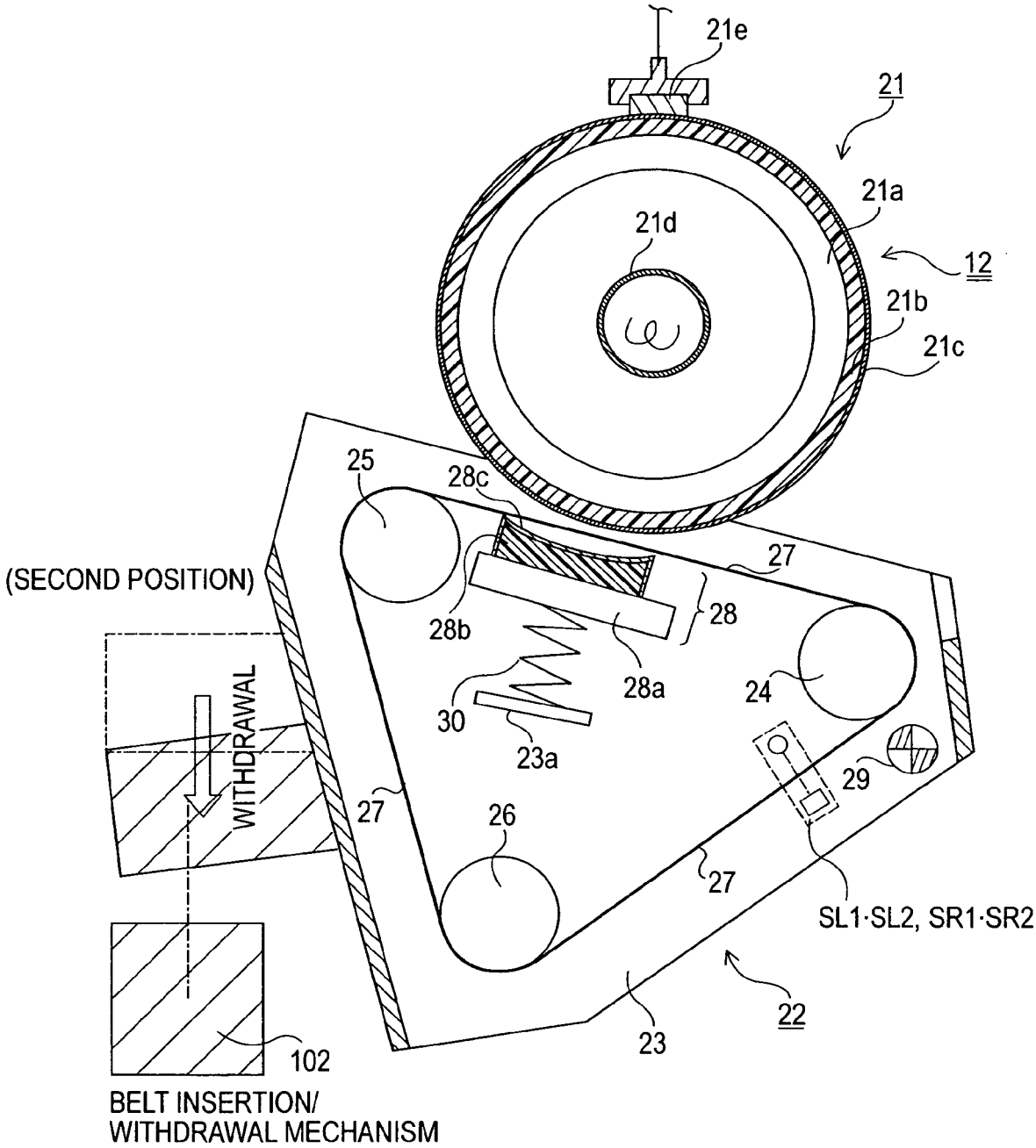
FIG. 3 is a cross-sectional view of the schematic structure of the belt fixing device according to the embodiment (in a withdrawal state of the pressure belt)

As shown in FIG. 3, the belt unit 22 is rotated about the pivot 29 away from the fixing roller 21 so that the separation roller 25 and the pressure belt 27 are brought out of contact with the lower surface of the fixing roller 21. The position in which the belt is separated from the fixing roller in such a manner is referred to as the second position below.

The non-contact state of the pressure belt 27 to the fixing roller 21 formed by rotating the belt unit 22 to the second position also includes a state where the pressure belt 27 is in contact with the fixing roller 21 in vacuo. Specifically, a mechanism separating the pressure pad from the belt is provided so as to form a depressurized state although the belt is in contact with the fixing roller by operating the mechanism.

The fixing process of unfixed toner images on the recording material P, as mentioned above, is performed in a state that the fixing nip N is formed between the fixing roller 21 and the pressure belt 27 by rotating the belt unit 22 into the first position.

The control will be described with reference to the block diagram of FIG. 4.

The control circuit 100 controls the belt insertion/withdrawal mechanism 102 so as to appropriately perform the belt insertion/withdrawal both in the standby mode and the normal fixing operation of the image-forming apparatus.

Specifically, in the standby mode, the belt unit 22 is located at the second position by rotating it away from the fixing roller 21 so as to bring the pressure belt 27 out of contact with the fixing roller 21. In the standby mode, the heat loss of the pressure belt 27 can be reduced by maintaining the pressure belt 27 separated from the fixing roller 21 in such a manner. When the recording material P is not introduced into the fixing nip N, such as during the idle period between sheets, the heat loss of the pressure belt 27 can also be further reduced by controlling the belt unit 22 so that it is rotated into the second position and held therein.

On the other hand, during the normal fixing operation, the control circuit 100 rotates the belt unit 22 into the first position so as to be held therein based on a image-forming start signal.

The control circuit 100 also controls a fixing roller drive mechanism 103 and a belt-drive roller drive mechanism 104 so as to rotate the fixing roller 21 and the belt drive roller 24 at predetermined speeds.

By the rotation of the belt drive roller 24, the pressure belt 27 is rotated, and the separation roller 25 and the steering roller 26 rotate following the rotation of the pressure belt 27.

The control circuit 100 also controls a heater power feeding circuit 105 so as to feed electric power to the heat source 21*d* for the fixing roller 21 and increase the temperature of the fixing roller 21. The surface temperature of the fixing roller 21 is detected by a temperature detecting element 21*e*, and the detected temperature information is fed to the control circuit 100.

The control circuit 100 controls the power supply from the heater power feeding circuit 105 to the heat source 21*d* so that the electric signal corresponding to the temperature of the fixing roller fed from the temperature detecting element 21*e* is maintained at a level corresponding to a predetermined fixing temperature. As a result, the surface temperature of the fixing roller 21 is maintained at the predetermined fixing temperature.

Then, as shown in FIG. 1, the recording material P carrying unfixed toner images t formed thereon is introduced into the fixing nip N from a position of the belt unit 22 adjacent to the belt drive roller 24, and is conveyed through the fixing nip N. In this pinched conveying process, the unfixed toner image surface of the recording material P adheres on the surface of the brake band 51, so that the toner images are heated by the heat of the fixing roller 21, and fixed on the surface of the recording material P. The recording material P is separated from the surface of the fixing roller 21 at the recording material exit of the fixing nip N by the pressing of the separation roller 25 into the elastic layer 21*b* of the fixing roller 21, and then is discharged.

Referring to FIG. 4, by an operation unit 101 of the image-forming apparatus, various conditions and pieces of information are entered into the control circuit 100.

Figure 5A:
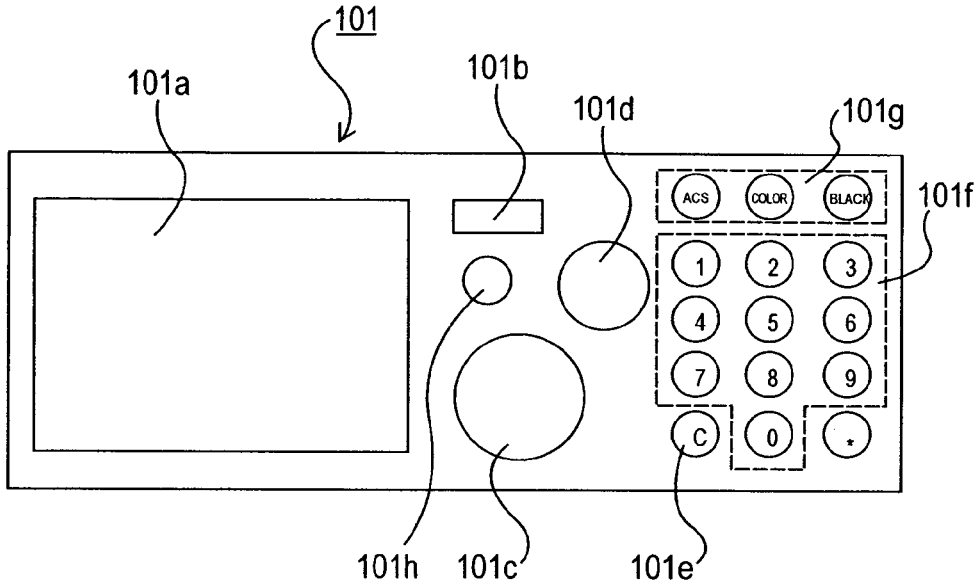
FIG. 5 is an exemplary view of an operation unit.
Figure 5B:
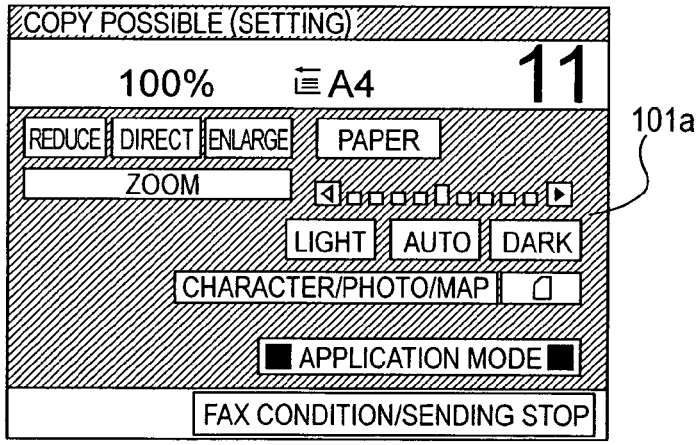

FIG. 5A is a plan view of the operation unit 101 according to the embodiment, and on a touch panel display 101*a*, the number of copying sheets, the selected sheet size, magnifications, and the copy density are normally displayed as shown in FIG. 5B.

A reset key 101*b* returns the copy mode to the standard; a start key 101*c* starts the copy operation; a stop key 101*d* cuts off the copy operation; a clear key 101*e* returns the copy mode to the standard; and ten-keys 101*f* are for setting the number of copying sheets.

Reference numeral 101*g* denotes color mode selection keys. Specifically, there are provided an ACS key for automatically determining whether a document is color or monochrome and to output the document color according to the determination, a color key for outputting color independently from the document, and a black key for outputting monochrome independently from the document. In this example, any one of the above-mentioned keys is lighted on.

Figure 5C:
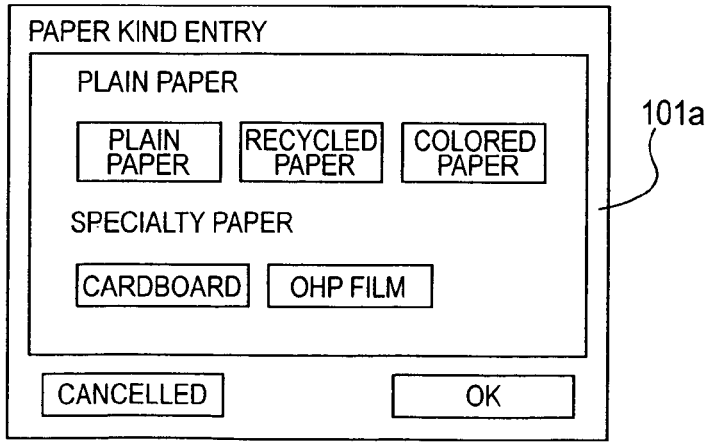

By pushing a user mode key 101*h*, a menu can be selected and the touch panel 101*a* is changed to a screen as shown in FIG. 5C so as to enter various kinds of the recording material to be printed in advance (recording material kind setting means).

Next, a rocking belt-deviation control mechanism will be described.

The belt fixing device described above is provided with a mechanism for controlling belt deviation. According to the embodiment, the belt rocking range in the direction of the width of the belt is controlled to fall within a predetermined range by the control mechanism.

That is, when it is detected by the below-mentioned detecting means that the belt deviates by a predetermined amount, in order to invert the rocking direction of the pressure belt 27 based on the detected information (to oppositely switch the deviation direction), the end portion of the steering roller 26 is displaced.

Figure 6A:
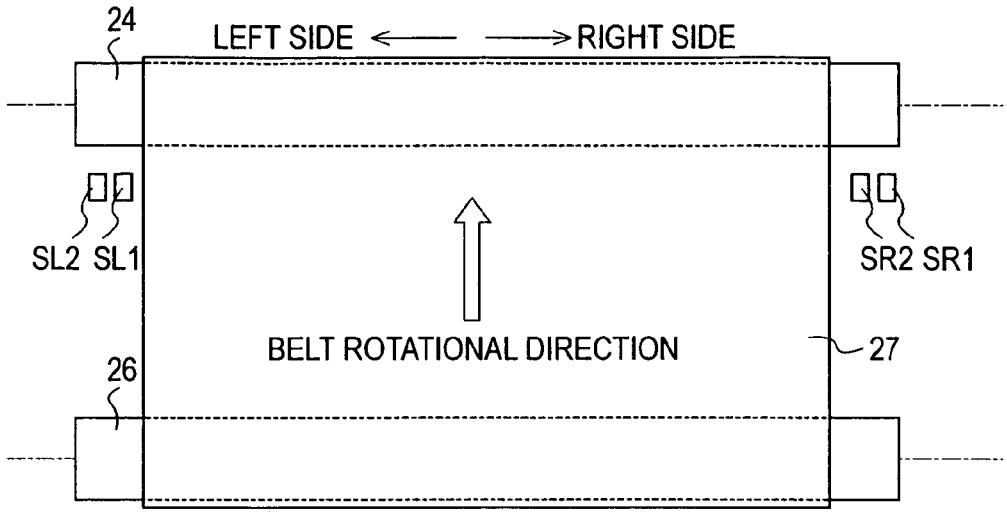
FIGS. 6A-6F are exemplary views of belt deviation detecting means.

First, the belt-deviation detecting means will be described with reference FIG. 6. FIG. 6A is a drawing of the part of the pressure belt between the belt drive roller 24 and the steering roller 26. Reference characters SL1, SL2, SR1, and SR2 denote sensors which together serve as the belt-deviation detecting means and which are arranged aside the pressure belt 27, two placed in each side in the width-wise direction at a predetermined interval.

Figure 6B:
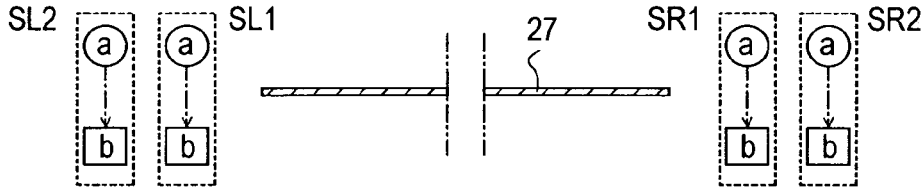
Figure 6C:
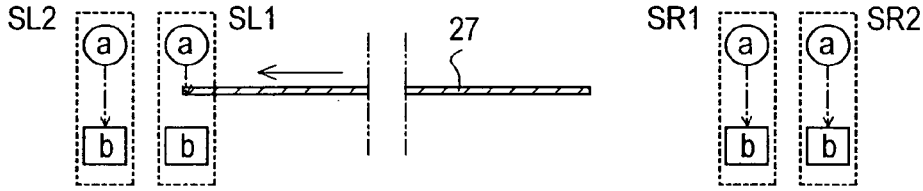

Each sensor, as shown in FIG. 6B, is a photo-sensor composed of a light emission element a and a light reception element b coupled with each other.

During the rotation of the pressure belt 27, if the pressure belt 27 is moved by a predetermined distance in the right or left wise direction, the belt edge enters between the light emission element a and the light reception element b so as to block the light path therebetween. Each sensor is turned on during the opening of the light path while being turned off during the shielding of the light path.

FIGS. 6A and 6B show a state that the rocking control is performed within a predetermined allowable rocking range between the first sensor SL1 and the first sensor SR1, and both the first sensors SL1 and SR1 are turned on. The control circuit 100 functioning also as rocking means determines that the pressure belt 27 is swung within a predetermined rocking range by the turning on of both the first sensors SL1 and SR1.

If the pressure belt 27 is moved toward the left so that the first sensor SL1 is turned off, the control circuit 100 determines that the pressure belt 27 has shifted to in excess to the left.

The control circuit 100 serving as the rocking means, displaces the steering roller 26 in a direction to return the pressure belt 27 on the opposite right by operating a below-mentioned belt deviation control mechanism 106 (a steering roller displacement mechanism).

Figure 6D:
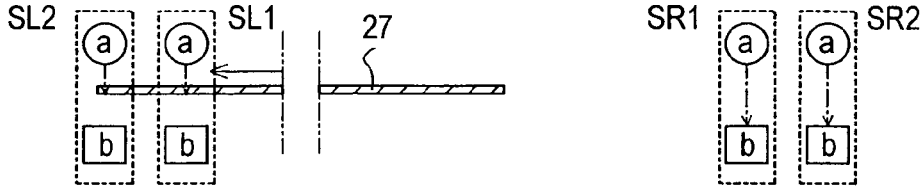

In spite of this, if the second sensor SL2 is also turned off with the belt left edge by further movement of the pressure belt 27 to the left as shown in FIG. 6D, rotation of the pressure belt 27 and the fixing roller 21 are stopped, and the entire apparatus is stopped directly thereafter. This stopping operation prevents the pressure belt 27 from being damaged. In spite of the operation of the deviation control mentioned above, if the belt does not respond thereto so as to sufficiently deviate, the control circuit 100 urgently stops the entire apparatus, including the fixing device, and displays the error on the operation unit. Thereafter, service personnel will be called.

Figure 6E:
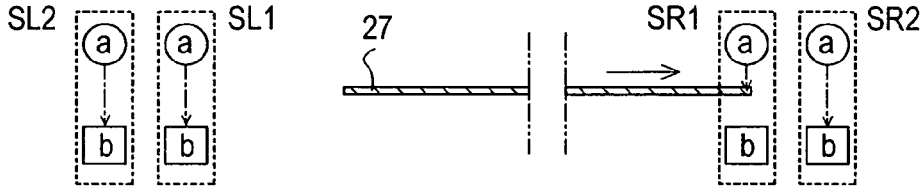

If the pressure belt 27 moves toward the right so that the first sensor SR1 is turned off with the belt right edge as shown in FIG. 6E, the control circuit 100 determines that the pressure belt 27 moves on the right in excess.

The control circuit 100 displaces the steering roller 26 in a direction to return the pressure belt 27 on the opposite left by operating the belt deviation control mechanism 106.

Figure 6F:
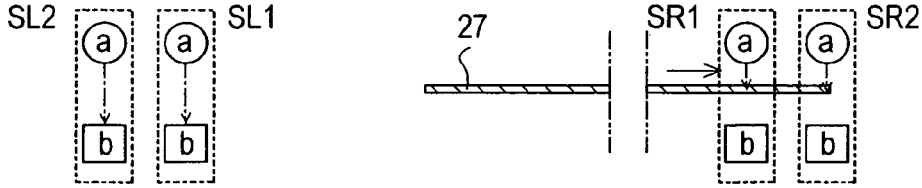

In spite of this, if the second sensor SR2 is also turned off with the belt right edge by the further movement of the pressure belt 27 to the right as shown in FIG. 6F, rotation of the pressure belt 27 and the fixing roller 21 are also stopped, and the entire apparatus is stopped directly thereafter.

Next, the belt deviation control mechanism 106 will be described with reference to FIGS. 7A to 9.

Figure 7A:
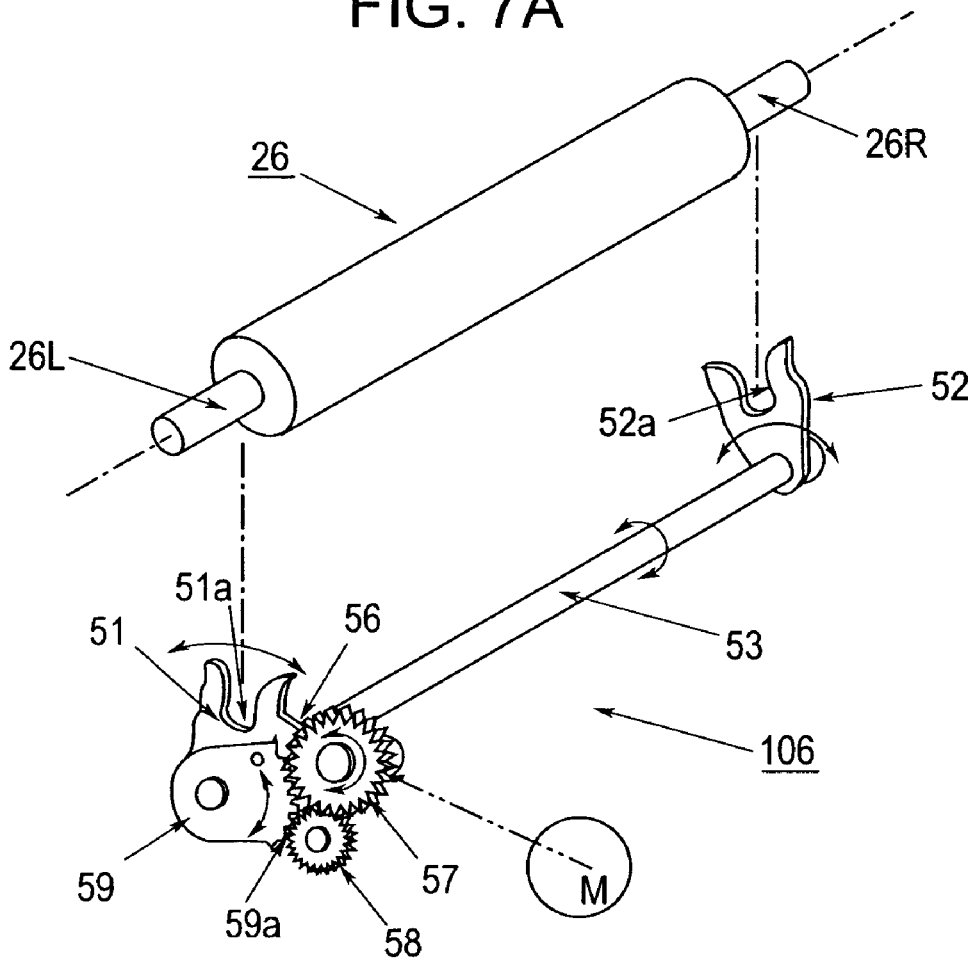
FIGS. 7A and 7B are exemplary views of a belt deviation control mechanism (steering roller displacing mechanism)
Figure 7B:
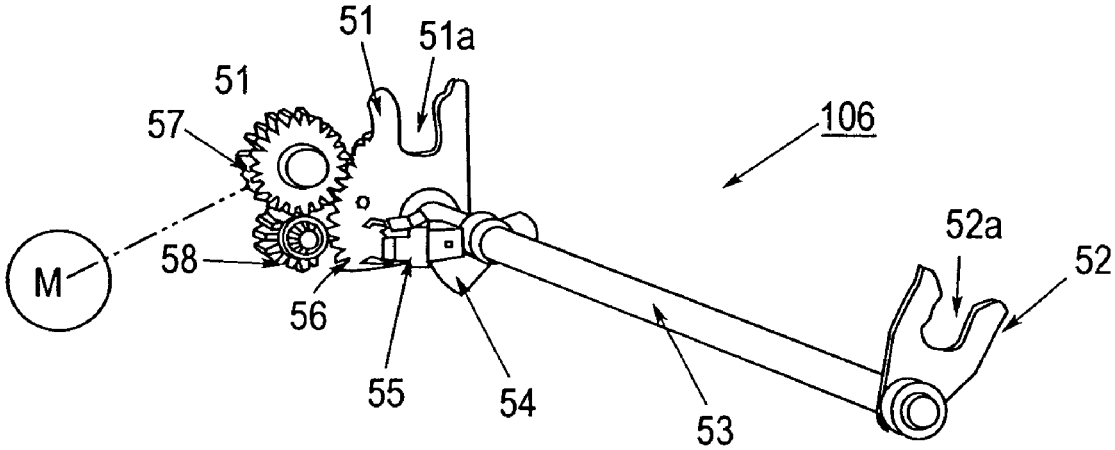

FIG. 7A is a perspective view of the belt deviation control mechanism 106 serving as displacing means; and FIG. 7B is a perspective view thereof viewed from a different angle.

The belt deviation control mechanism 106 includes left and right support members 51 and 52 and a control shaft 53 arranged along the rotational axis of the left and right support members 51 and 52. The left support member 51 is rotatably supported on the left end of the control shaft 53 while the right support member 52 is fixed to the right end of the control shaft 53. The control shaft 53 is provided with a detection flag 54, and the rotational position of the control shaft 53 is detected by a detection sensor 55 arranged to oppose the detection flag 54.

The left journal 26L of the steering roller 26 is mounted in a U-groove 51*a* of the left support member 51 while the right journal 26R is mounted in a U-groove 52*a* of the right support member 52.

A gear 56 is formed on the left support member 51 so as to mate with an input gear 57. The input gear 57 is engaged with a control arm 59 having a gear 59*a* formed thereon via an idler gear 58. The control arm 59 is fixed to the left end of the control shaft 53. The idler gear 58 is not mated with the gear 56 of the left support member 51 in the vertical positional relationship.

The above-mentioned input gear 57 is forward/reverse rotated by a forward/reversal motor (stepping motor) M. The driving force of the input gear 57 is transmitted to the left support member 51 so as to rotate the left support member 51. The driving force of the input gear 57 is also transmitted to the right support member 52 via the idler gear 58 and the control shaft 53 so as to rotate the right support member 52.

In the structure described above, when the input gear 57 is forward/reverse rotated by a predetermined rotational angle, the left support member 51 is rotated by a predetermined rotational angle in a direction opposite to the rotational direction of the input gear 57. By the rotation of the input gear 57, the control arm 59 is rotated via the idler gear 58 by a predetermined rotational angle in the same direction as that of the input gear 57. The control arm 59 is fixed to the control shaft 53 so that the right support member 52 is rotated by the predetermined rotational angle in the same direction.

Figure 8:
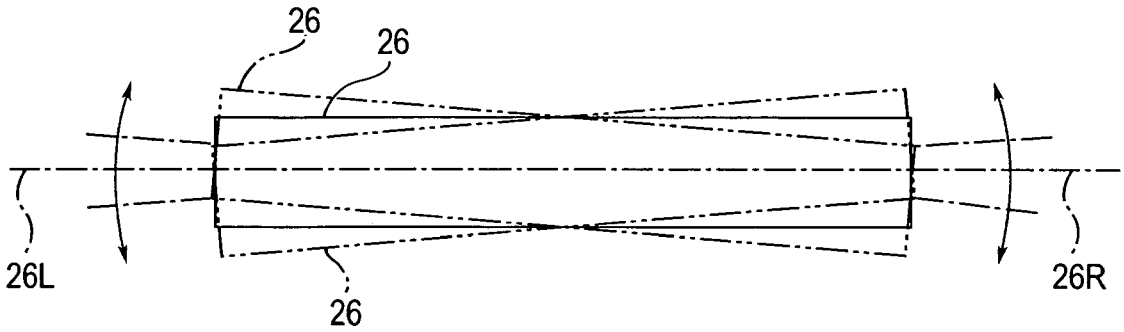
FIG. 8 is a first exemplary view of the displacing operation of the steering roller.

The left journal 26L of the steering roller 26 mounted in the U-groove 51*a* of the left support member 51 and the right journal 26R of the steering roller 26 mounted in the U-groove 52*a* of the right support member 52, as shown in FIG. 8, are moved by a predetermined length in directions opposite to each other. That is, the left end and the right end of the steering roller 26 are moved by the predetermined length in directions opposite to each other, so that the relative position of the steering roller 26 to the belt drive roller 24 and the separation roller 25 is displaced (parallel or twist is changed). Thereby, the belt deviation direction is alternately changed so that the belt deviation movement falls within a predetermined movement range.

Figure 9:
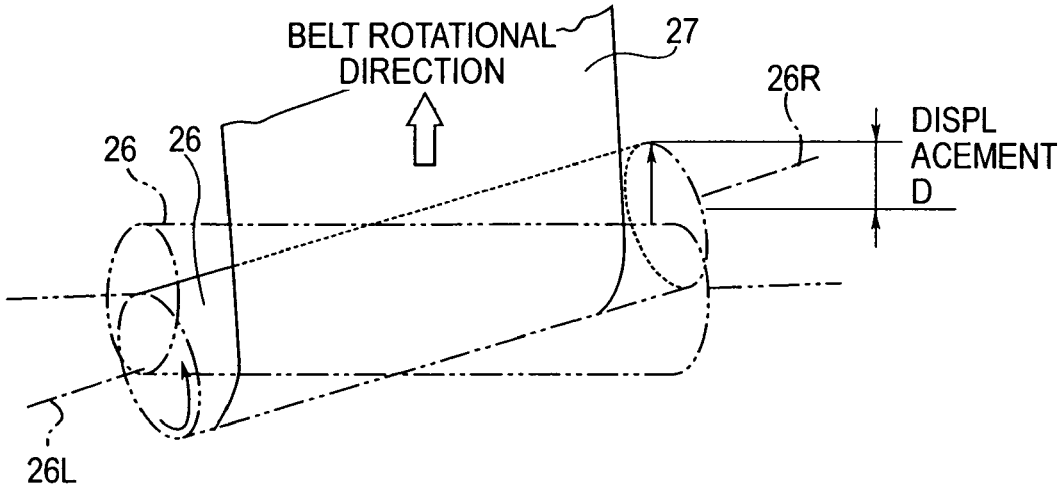
FIG. 9 is a second exemplary view of the displacing operation of the steering roller.

Displacing the end of the steering roller 26 moves one edge of the pressure belt 27 in the direction in which a tension is applied to the pressure belt 27 and moves the other edge in a direction in which a tension is alleviated. According to the embodiment, the end displacement means to move one end of the steering roller 26 by a predetermined amount in a direction away from the belt drive roller 24 as well as to move the other end in the opposite direction in that a belt tension is alleviated. In order to make the pressure belt 27 deviate in the right, as shown in FIG. 9, one journal of the steering roller 26 is displaced. The belt tension difference is thereby generated back and forth, so that the belt moves to the right. Similarly, by displacing the other journal, the belt can be moved in the opposite direction.

Next, steps to determine belt rocking conditions will be described. In this example, as the belt rocking conditions, steps determining the displacement of the steering roller 26 will be described with reference to FIG. 10. The displacement is determined by the control circuit 100 (the rocking means).

In Step S1 to Step S3, the tendency of belt deviation is first estimated from detection results of the belt deviation sensors.

At Step S1, it is determined whether the deviation at this time toward the left, i.e., the first sensor SL1 is determined to be turned off.

At Step S2, it is determined whether the deviation at the previous time it was toward the left.

At Step S3, from detected results of Step S1 and Step S2, the present belt deviation tendency is determined. For example, if the belt deviates toward the left and also deviated to the left the previous time, since the belt deviates in the left although the steering roller 26 has been displaced to make the belt deviate in the right in the previous time, the belt is determined to have the left deviation tendency so as to increase the tendency. If the belt deviates toward the left and deviated to the right the previous time, since the steering roller 26 was displaced to make the belt deviate in the left in the previous time, the belt is determined to have not deviated to the left due to the left deviation tendency so as to reduce the tendency. In the same way, when the belt deviates to the right, it is similarly determined. The tendency determined at Step S3 will be utilized at Step S9.

In the following Steps, the practical displacement D (FIG. 9) is determined. The displacement D represents the movement when the end of the steering roller 26 is moved. According to the embodiment, the displacement D represents the displacement in millimeters of the end of the steering roller 26 in the direction perpendicular from the parallel state with the belt drive roller 24.

At Step S4, when a constant Z is the product of a number a (belt-speed factor displacement) and a belt rotation peripheral speed V ($V \neq 0$), the number a is obtained.

This is because the displacement D is necessary to be set small since if the belt rotational speed is high, the deviation speed is also increased. It is established that the belt rotation speed V is inverse proportion to the number a.

According to the embodiment, when the belt rotation speed is 100, in order to have a mode moving at a speed of 50, Step a=1, and at the speed 50, a=2.

At Step S5, it is determined that the pressure belt 27 is in contact with or out of contact with the fixing roller 21.

At Step S6, a value varying with the pressure applied to the pressure belt is established as a number b (belt insertion/withdrawal displacement).

This is because when the pressure belt 27 is out of contact with the fixing roller 21, the pressure applied to the pressure belt is reduced in comparison with the case where it is in contact, so that the deviation speed of the pressure belt (rocking speed) is increased. Hence, in the displacement D in a non-contact state of the pressure belt, it is preferable that the number b be set smaller than in a contact state of the pressure belt. According to the embodiment, it is set that in the contact state of the pressure belt, b=2, and in the non-contact state, b=1.

At Step S7, the resistance on the contact surface of the pressure belt is set as a number c (belt surface resistance displacement).

When the fixing roller 21 is in contact with the pressure belt and the recording material P is not conveyed, the sliding resistance on the surface of the fixing roller 21 is established.

During conveying the recording material P, when the recording material P is a sheet with small surface sliding resistance, such as coated paper, from recording material information fed from recording material kind setting means 101*a* of the operation unit 101 shown in FIG. 5C, the belt is liable to deviate in comparison with normal paper. Accordingly, it is preferable to set the displacement D, i.e., the number c, to be small.

According to the embodiment, c=2 for normal paper, c=1 for coated paper, and c=0 when the pressure belt is out of contact with the fixing roller.

At Step S8, the displacement D for the present deviation is determined from the numbers a, b, and c determined at Steps S4, S6, and S7, respectively.

The determination method of the displacement D employs a subtraction system in that the maximum displacement is defined as the displacement when the belt rotational speed is at its minimum; the pressure belt is in contact with the fixing roller; and the recording material is not conveyed, and the belt speed difference is subtracted from the maximum displacement, so that if the belt is out of contact with the roller, the belt speed is subtracted therefrom.

Conversely, the minimum displacement is defined as the displacement when the belt rotational speed is at its maximum, and the pressure belt is out of contact with the fixing roller, and the belt speed may be added thereto.

Simply, the displacement D is defined as the sum of the minimum displacement and the numbers a, b, and c.

According to the embodiment, the minimum displacement is 10, and the displacement D is obtained by the calculation of 10+a+b+c.

At Step S9, the displacement D is complemented by factoring the above-mentioned deviation tendency into the displacement D defined at Step S8. For example, when the belt has a tendency of left deviation and making the belt deviate to the left, the displacement D determined at Step S8 is complemented to reduce it. According to the embodiment, if the displacement D obtained at Step S8 has a deviation tendency of +1, 0.9 is multiplied, and conversely, if having a tendency of −1, 1.1 is multiplied.

Parameters (rocking conditions) for determining the displacement D may adopt only the belt peripheral speed and the external pressure applied to the belt, if the load applied to the belt makes little difference from the recording material kind and the presence of the recording material in the fixing nip.

In other words, it is preferable that the belt rocking condition be changed corresponding to the load applied to the belt. Specifically, in accordance with the load applied to the belt, preferably, at least one of the displacements of the steering roller and the belt peripheral speed is changed.

For example, when the load applied to the belt is small (separated from the fixing roller), and the belt peripheral speed is switched to a low speed while the load applied to the belt is large (abutted to the fixing roller), the belt peripheral speed is switched to a high speed. Simultaneously, the displacement of the roller is set at the same value in any of the cases.

That is, even when the load applied to the belt is changed, there is nothing wrong as long as the belt is swung within a predetermined allowable rocking range.

By determining the displacement D in such a manner, the belt rocking can be appropriately controlled even in a situation that the load (external pressure) applied to the belt fluctuates.

During the abutting of the belt against the fixing roller, when the peripheral speed of the fixing roller is switched to the high/low speed corresponding to the kind of the recording material together with the kind of the belt, preferably, the belt rocking conditions are changed in the same way as those of the examples mentioned above. This is a rocking control considering the correspondence of the belt rocking speed to the belt peripheral speed when the load applied to the belt scarcely fluctuates.

Specifically, when the belt peripheral speed is high, the displacement of the steering roller is reduced, and when the belt peripheral speed is low, the displacement of the steering roller is increased. That is, in accordance with the switching of the belt peripheral speed, the displacement of the steering roller is changed.

Figure 10:
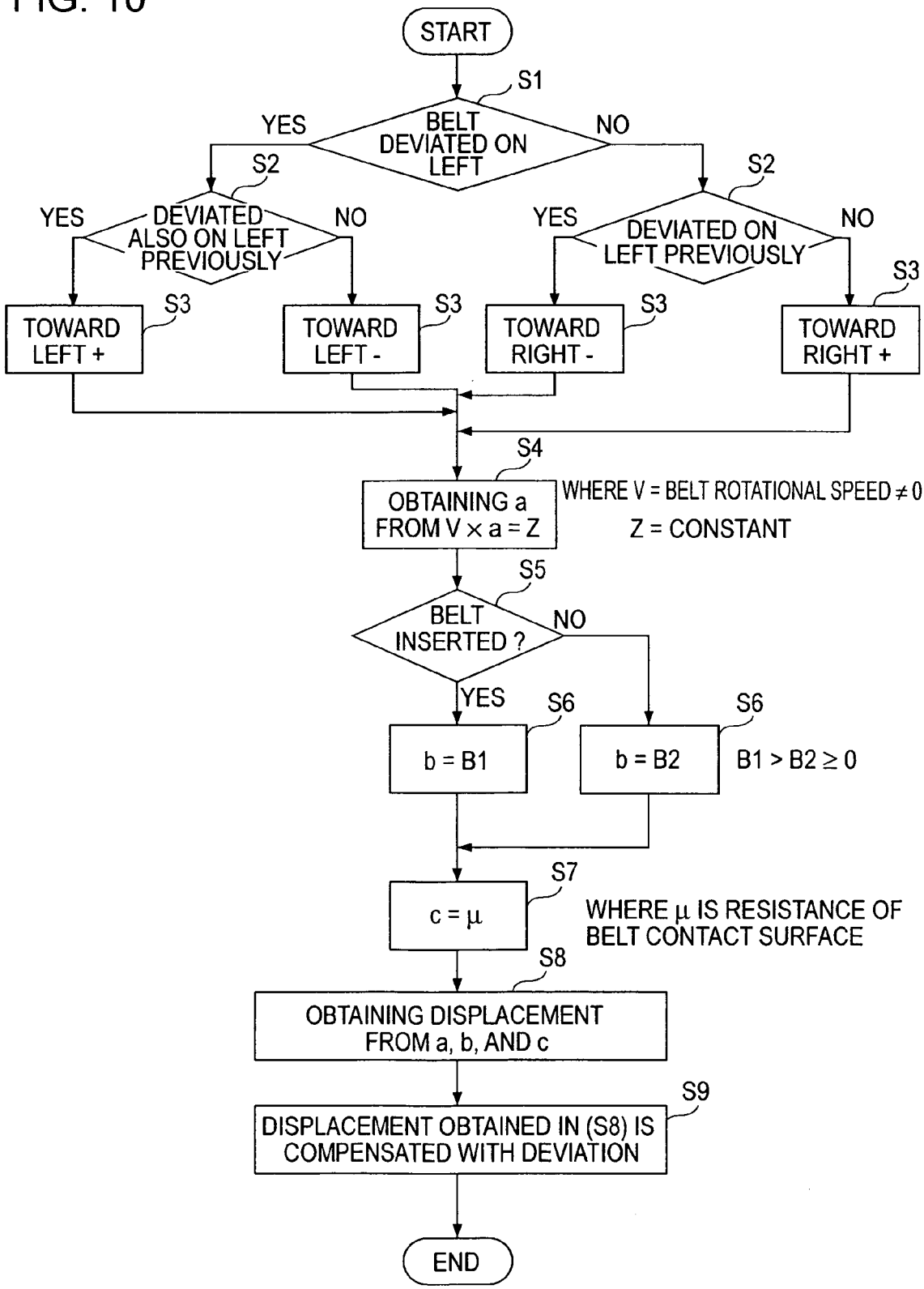
FIG. 10 is a flow sheet of the determination of the steering roller displacement.

The values shown in the process of FIG. 10 and in the embodiment are examples, so that they may be appropriately changed due to the modification in structure and component material.

That is, the control circuit 100 can determine the displacement of the steering roller 26 (compliment the belt deviation control) as follows in addition to the examples described above.

1) Corresponding to the contact/non-contact between the fixing roller 21 and the pressure belt 27, the displacement of the end of the steering roller 26 is determined by the belt deviation control mechanism 106.

2) When the pressure belt 27 is in contact with the fixing roller 21, in accordance with the presence of the conveyed recording material in the fixing nip and the recording material kind fed from the recording material kind setting means, the displacement of the end of the steering roller 26 is determined by the belt deviation control mechanism 106.

3) Corresponding to the peripheral speed of the pressure belt 27, the displacement of the end of the steering roller 26 is determined by the belt deviation control mechanism 106.

4) The behavior of the pressure belt after the belt deviation control is complimented by the displacement determined as the above-mentioned items 1) to 3) is reviewed so as to feed it back to the next belt deviation control.

That is, in accordance with one or the combination of two or more of destabilizing factors of the belt deviation control, such as the belt contact/non-contact, the presence of the conveyed recording material, the recording material kind, and the belt peripheral speed, and further corresponding to the fed back information, it is preferable that the belt deviation control be complimented.

As a result, even when the belt deviation balance is changed due to the fluctuation of the load applied to the belt, the belt deviation control can correspond thereto so as to stabilize the belt deviation control without complicating the control. The reliability of the device can be improved by achieving stable conveying with the belt for a long time.

In addition, the image heating apparatus may include not only the fixing device described above but also a gloss increaser for increasing the gloss of images by again heating the images fixed on a recording material.

While the present invention has been described with reference to exemplary embodiments, it is to be understood that the invention is not limited to the disclosed exemplary embodiments, but also encompasses all equivalent modifications, structures, and functions.

This application claims the benefit of Japanese Application No. 2004-304218 filed Oct. 19, 2004, which is hereby incorporated by reference herein in its entirety.

What is claimed is:

1. A toner image heating apparatus comprising:

a rotary member and an endless belt configured and positioned to heat a toner image on a sheet at a nip portion therebetween;

a supporting roller configured and positioned to support said endless belt;

a detector configured and positioned to detect that said endless belt is beyond a predetermined zone in a width direction of said endless belt;

a displacing device configured and positioned to displace a longitudinal end of said supporting roller based on an output of said detector so that said endless belt is within the predetermined zone in the width direction;

a moving device configured and positioned to move said endless belt to an image heating position where an image heating process is executable; and a controlling device configured and positioned to control a displaced amount of the longitudinal end of said supporting roller by said displacing device so that the displaced amount is smaller when a sheet with a small surface sliding resistance is at the nip portion than when a sheet with a large surface sliding resistance is at the nip portion.

2. The apparatus according to claim 1, wherein said rotary member is contactable to the toner image on the sheet.

3. The apparatus according to claim 1, wherein said toner image heating apparatus fixes the toner image onto the sheet by heating the toner image on the sheet at the nip portion.

* * * * *